US005088163A

United States Patent [19]

van Riesen

[11] Patent Number: 5,088,163

[45] Date of Patent: Feb. 18, 1992

[54] BELT LOCK

[76] Inventor: Reiner van Riesen, Besenheide 36, 2200 Elmshorn, Fed. Rep. of Germany

[21] Appl. No.: 544,845

[22] Filed: Jun. 27, 1990

[30] Foreign Application Priority Data

Jun. 27, 1989 [DE] Fed. Rep. of Germany ..... 8907836

[51] Int. Cl.[5] ..... A44B 11/25

[52] U.S. Cl. ..... 24/573.5; 24/632; 24/642

[58] Field of Search ..... 24/573.5, 573.6, 573.1, 24/573.3, 632, 633, 642, 656; 297/481, 468, 488

[56] References Cited

U.S. PATENT DOCUMENTS

| | | | |
|---|---|---|---|
| 3,520,034 | 7/1970 | Glauser et al. | 24/573.5 |
| 3,591,902 | 7/1971 | Lohr | 24/632 |
| 4,809,410 | 3/1989 | Van Riesen | 24/573.5 |
| 4,945,615 | 8/1990 | Anthony et al. | 24/642 |

FOREIGN PATENT DOCUMENTS

| | | | |
|---|---|---|---|
| 1448317 | 9/1976 | United Kingdom | 24/573.5 |

*Primary Examiner*—Victor H. Sakran

*Attorney, Agent, or Firm*—Dvorak and Traub

[57] ABSTRACT

A seat belt lock for a belt retaining system, in particular for a child's seat in an automotive vehicle, comprises two belt strap holding pieces having slots through which shoulder strap sections of a seat belt strap are passed to run through the slots. The shoulder strap sections continue beyond the slots as a lap belt section of the seat belt. The lock comprises a lock housing containing a lock mechanism, the holding pieces having at least one tongue for insertion through an insertion side of the lock housing into the lock mechanism. The holding pieces are shaped to engage along the insertion side of the housing and also at least partially along its longitudinal sides. The slots in the holding pieces are angled by about 45° with respect to the longitudinal axis of the lock and are partially set back from the insertion side of the housing.

3 Claims, 1 Drawing Sheet

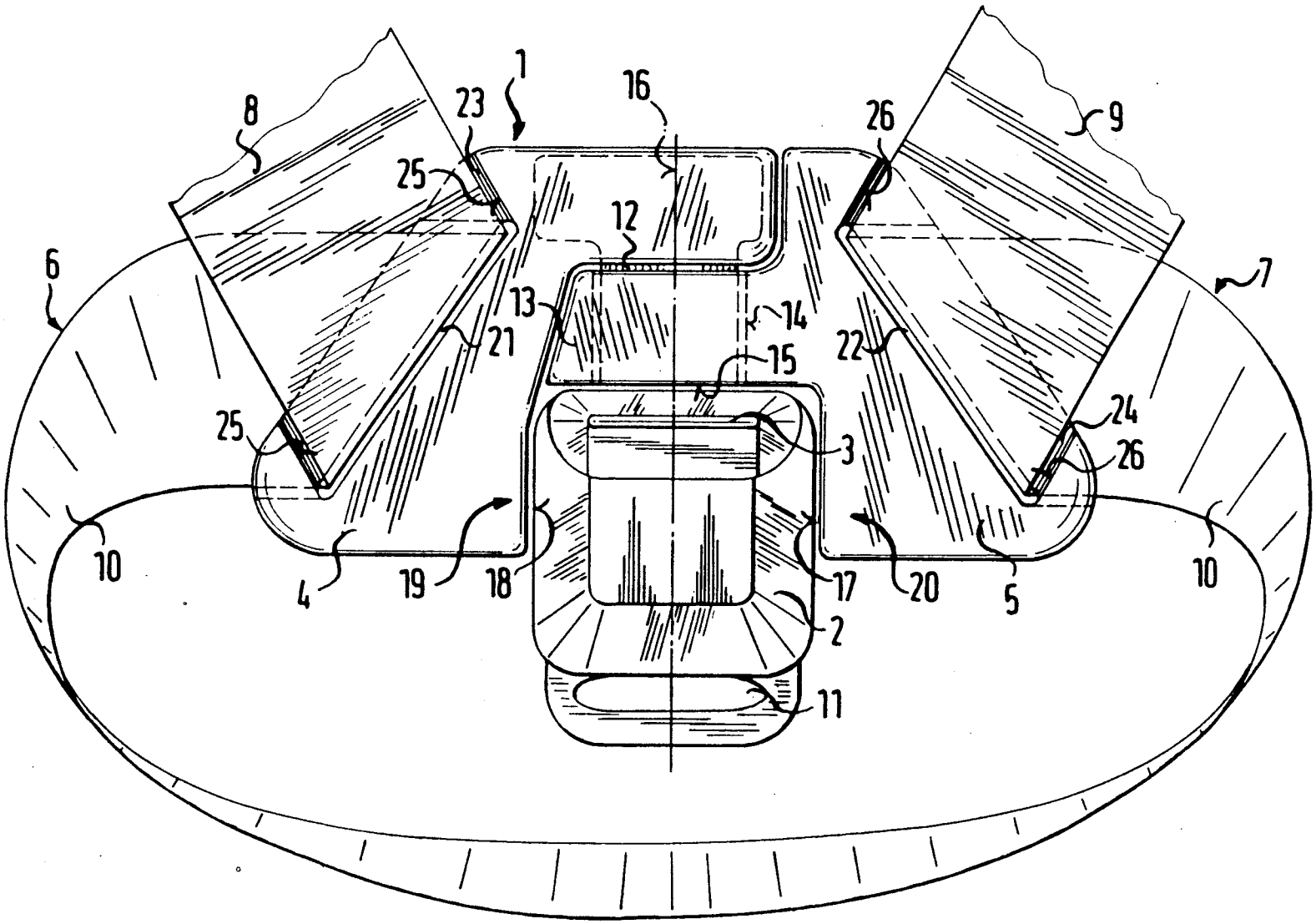
1
2
3
4
5
6
7
8
9
10
11
12
13
14
15
16
17
18
19
20
21
22
23
24
25
26

BELT LOCK

The Innovation proceeds from a belt lock for belt strap retaining systems, in which the shoulder belt straps on running through the lock continue into the lap belt, in particular for children's dished seats, consisting of a lock housing with a closing mechanism and of two belt strap holding pieces, which are able to be inserted into the mechanism, are separable therefrom on pressing a button, and which are each provided with an inclined slit for the respective belt strap to run through, wherein the holding pieces which lie against each other accordingly form a substantially closed contact surface.

In the belt locks of the above-mentioned type which are used in practice, the two belt strap holding pieces are constructed and are arranged with respect to the lock housing such that when placed against each other they form a relatively small body contact surface and that their slits are unfavourably placed for the guidance of the belt straps. Moreover, the belt strap holding pieces which are connected with the lock housing project a long way from the lock housing, so that the lock as a whole rests uncomfortably against the body of the person secured by the belt strap retaining system and thereby brings about an undesired pressure onto the body. The unfavourable slit position prevents the belt straps from running easily through the holding pieces under all circumstances.

The object of the innovation consists In the improvement of a belt lock of the type indicated in the introduction, to the effect that the belt lock, with a compact construction when In the state of use, does not cause any disturbing pressure sensation and always ensures that the belt straps run through without difficulty.

The solution to this problem proceeds from the belt lock indicated in the introduction and is further characterised in that the two belt strap holding pieces extend without spacing with respect to the lock housing firstly along the insertion side and then at least partially along the two longitudinal sides of the lock housing and that the slits of the holding pieces are arranged at an angle of substantially 45° to the central longitudinal axis of the lock and such that—when viewed in lateral projection—they are partially set back with respect to the insertion side of the lock housing.

In a preferred embodiment of the belt lock according to the innovation, the belt strap holding pieces extend along the longitudinal sides between half and three quarters the length of the longitudinal sides of the belt lock. The slits of the belt strap holding pieces are arranged so as to be set back by a third to half their length with respect to the insertion side of the housing.

When seen in top view, such a belt lock has an approximately butterfly-shaped appearance and is consequently compact In construction, in which, nevertheless, an increased contact surface is achieved through the belt strap holding pieces, because the latter are constructed with a larger area without, however, therefore having outwardly larger dimensions. The belt strap holding pieces, which now extend substantially away from the central longitudinal axis of the lock and adjoining and along the lock housing are particularly suitable for vide belt straps. Through the consequently butterfly-shaped outline of the overall lock, a reduced contact pressure thereof results against the body of a person secured with this lock.

Furthermore, the particular angular position of the slits in the belt strap holding pieces causes the belt strap to run through the slits without difficulty under all circumstances. A fastening or clamping of the belt strap in the end regions of the slits is now avoided with certainty. The proposed slit position relative to the lock housing and the higher arrangement of the lock housing in relation to the holding pieces, which is necessitated thereby, additionally makes it possible for there to be more play for the lock housing for its assembly, i.e. the distance of the lock housing from its lower attachment point on the retaining system is increased. Consequently, the position of the entire lock in the retaining system and in relation to the person who is to be secured can be optimized.

The innovation is explained in further detail below with the aid of an example embodiment represented in the attached, single drawing.

The belt lock, which is designated generally by 1, consists of a lock housing 2, which contains the conventional lock mechanism, not shown, and which is unlocked by means of a release button 3, and of two belt strap holding pieces 4 and 5 for the holding and guiding of a belt strap or respectively of two belt strap sections 6 and 7.

The belt lock which is shown is used in connection with belt strap retaining systems in which the shoulder belt straps 8,9, on running through the holding pieces which are locked with the lock housing 2, continue into the lap belt 10, as is shown in the drawing. Such belt systems are used as a rule in connection with children's dished seats, which are used in motor vehicles. The lap belt is thereby guided through slits in the dished seat and then runs around the outside of the dished seat. Alternatively, the lap belt sections 10 may also be attached laterally on the dished seat. The belt strap sections 8 and 9 run in a conventional manner further upwards and form the shoulder belts, whilst the lock housing 2 has a lower eye 11 for the application of a separate, generally short belt strap piece.

In the case shown, the belt strap holding piece 4, consisting of plastics material, has a conventional, inset metal tongue 12, which cooperates with the above-mentioned closing mechanism, whilst the other belt strap holding piece 5, consisting entirely of plastics material, has a continuation 13 with a passage 14, and is arranged with the continuation on the tongue 12 with an insertion fit. Alternatively, however, both holding pieces 4,5 may have a tongue, wherein then both tongues engage into the closing mechanism.

The belt strap holding pieces 4, 5 are constructed In their outline such that with the appropriate Insertion position, without spacing with respect to the lock housing 2 they extend firstly along the housing insertion side 15 or respectively laterally away from the central longitudinal axis 16 of the lock i and then extend along the longitudinal sides 17 and 18 of the lock housing. In the case shown, the holding piece 5 only adjoins the housing on the Insertion side, but the other holding piece 4 with a corresponding construction can also adjoin the insertion side 15 of the housing 2, for example when it has its own tongue.

Preferably, the holding pieces 4, 5 extend over a portion of the longitudinal sides 17,18 and namely over a section which corresponds to approximately half to three quarters of the length of the longitudinal sides of the lock housing 2. Hereby, regions 19,20 are formed on the holding pieces, which represent additional contact surfaces for the support of the entire lock against the body of a person and which have a pressure-reducing effect.

The holding pieces 4, 5 each have a conventional slit 21 or respectively 22 for the belt strap sections 6,7 to run through. These slits, with the central longitudinal axis 16 of the lock, form an angle of substantially 45°, as is shown In the drawing. The slits are additionally arranged such that they are set back in relation to the insertion side 15 of the housing 2, such that—when viewed in lateral projection—they partially overlap the lock housing. This overlapping is preferably a third to a half of the length of the slits.

Adjoining the slits 21,22 are sunken belt strap guides 23 or respectively 24, which are outwardly directed on both sides, the end faces 25 or respectively 26 of which guides run in the direction of the respective running direction of the respective belt strap sections 8,9, 10, in order to support the guiding of the belt strap sections.

I claim:

1. A belt lock for a belt strap retaining system in which shoulder strap sections of a belt continue through the lock into a lap belt section thereof, the belt lock comprising:

a lock housing having a lock closure mechanism and having an insertion side and two longitudinal sides on either side of a longitudinal axis of the lock;

a pair of belt strap holding pieces having means for insertion into said lock mechanism for locking engagement therein, each of said holding pieces having an inclined slot for receiving a respective belt strap section to allow it to run through said slot, said holding pieces lying against each other to provide a substantially continuous body contact surface; and a release button on the lock housing for causing said mechanism to release said insertion means;

wherein said holding pieces, which lie adjacent to each other, cooperate to enclose the lock housing in unspaced relationship therewith along said insertion side thereof and at least along between half and three-quarters of the length of said longitudinal sides thereof, said slots being angled by substantially 45° with respect to said longitudinal axis of the lock and being set back with respect to the insertion side of the lock housing to the extent of between a third and a half of their lengths.

2. A belt lock as claimed in claim 1, wherein sunken guides for said belt strap sections are provided adjacent to said slots, said guides being outwardly directed on each side and having end faces extending in running directions of said belt strap sections through said slots.

3. A belt lock as claimed in claim 1, wherein the insertion means comprise at least one tongue for insertion through the insertion side of the lock housing.

* * * * *